US007806471B2

(12) United States Patent
Nishimoto

(10) Patent No.: US 7,806,471 B2
(45) Date of Patent: Oct. 5, 2010

(54) CUSHION FOR BABY CHAIR

(75) Inventor: Noriko Nishimoto, Saitama (JP)

(73) Assignee: Combi Corporation, Tokyo (JP)

( * ) Notice: Subject to any disclaimer, the term of this patent is extended or adjusted under 35 U.S.C. 154(b) by 0 days.

(21) Appl. No.: 11/487,478

(22) Filed: Jul. 17, 2006

(65) Prior Publication Data

US 2007/0029851 A1 Feb. 8, 2007

(30) Foreign Application Priority Data

Jul. 21, 2005 (JP) ..... 2005-211925

(51) Int. Cl.
*A47D 15/00* (2006.01)

(52) U.S. Cl. ..... 297/219.12; 5/655

(58) Field of Classification Search ..... 297/219.12, 297/485, 391, 397, 219.1; 5/655
See application file for complete search history.

(56) References Cited

U.S. PATENT DOCUMENTS

| | | | | |
|---|---|---|---|---|
| D206,117 | S | 11/1966 | Levy | |
| 4,383,713 | A | 5/1983 | Roston | |
| 4,394,783 | A | 7/1983 | Simmons | |
| 4,631,766 | A | 12/1986 | Semmler et al. | |
| 4,912,788 | A | 4/1990 | Lonardo | |
| 5,056,533 | A | 10/1991 | Solano | |
| 5,129,705 | A * | 7/1992 | Wray | 297/397 |
| 5,228,745 | A * | 7/1993 | Hazel | 297/229 |
| 5,310,245 | A * | 5/1994 | Lyszczasz | 297/219.12 |
| 5,383,711 | A | 1/1995 | Houghtelilng | |
| 5,439,008 | A | 8/1995 | Bowman | |
| 5,735,576 | A * | 4/1998 | Pepys et al. | 297/397 |
| 5,826,287 | A | 10/1998 | Tandrup | |
| 5,842,739 | A | 12/1998 | Noble | |
| 5,916,089 | A * | 6/1999 | Ive | 5/655 |
| 6,012,189 | A * | 1/2000 | Dudley | 5/655 |
| 6,045,184 | A | 4/2000 | Nakagawa | |
| 6,052,849 | A | 4/2000 | Dixon et al. | |
| D427,785 | S * | 7/2000 | Kassai | D6/333 |
| 6,088,855 | A | 7/2000 | Connolly | |
| 6,139,100 | A * | 10/2000 | Baskin-Lockman et al. | 297/250.1 |
| 6,152,525 | A * | 11/2000 | Carine et al. | 297/216.11 |
| D441,967 | S * | 5/2001 | Reithmeier | D6/333 |
| 6,266,832 | B1 | 7/2001 | Ezell | |

(Continued)

FOREIGN PATENT DOCUMENTS

| | | |
|---|---|---|
| EP | 011039 | 2/1979 |

(Continued)

*Primary Examiner*—Peter R. Brown
(74) *Attorney, Agent, or Firm*—Young & Thompson

(57) ABSTRACT

A cushion for a baby chair comprises a head pad, a back pad and a buttocks pad arranged on a seat of the baby chair. The head is supported by a neck support portion projecting along a lower edge of the head pad and a pair of temporal support portions projecting along both side edges of the head pad. A trunk is supported from a side by a pair of trunk support portions projecting along both side edges of the back pad and extending from an upper to a lower edge of the back pad. Buttocks are supported by a buttocks support portion projecting along a lower edge of the buttocks pad. A thigh and a knee are supported by a pair of thigh support portions projecting along both side edge of the buttocks pad. The head pad, the back pad, and the buttocks pad are mutually detachable.

10 Claims, 13 Drawing Sheets

U.S. PATENT DOCUMENTS

| | | | | |
|---|---|---|---|---|
| 6,292,964 | B1 | 9/2001 | Rose et al. | |
| 6,341,818 | B1 * | 1/2002 | Verbovszky et al. | 297/219.12 |
| 6,363,558 | B1 * | 4/2002 | Dunne | 5/655 |
| 6,415,969 | B1 * | 7/2002 | Higuchi | 224/160 |
| 6,454,352 | B1 | 9/2002 | Konovalov et al. | |
| 6,481,794 | B1 | 11/2002 | Kassai et al. | |
| 6,543,844 | B1 * | 4/2003 | Ryan et al. | 297/219.12 |
| 6,752,457 | B2 * | 6/2004 | Gold et al. | 297/219.12 |
| 6,926,359 | B2 * | 8/2005 | Runk | 297/219.12 |
| 6,951,367 | B1 | 10/2005 | Dinnan | |
| 7,252,330 | B2 | 8/2007 | Lincoln | |
| 7,311,357 | B2 * | 12/2007 | Gold et al. | 297/219.12 |
| 2002/0014793 | A1 | 2/2002 | Santha | |
| 2004/0145224 | A1 * | 7/2004 | Kassai et al. | 297/219.12 |
| 2004/0251721 | A1 | 12/2004 | Yoshida | |
| 2005/0210592 | A1 | 9/2005 | Littlehorn et al. | |
| 2007/0011816 | A1 | 1/2007 | Kigushi et al. | |
| 2008/0034505 | A1 | 2/2008 | Thomas | |
| 2009/0007336 | A1 | 1/2009 | Kassai et al. | |

FOREIGN PATENT DOCUMENTS

| | | |
|---|---|---|
| JP | 08-107816 | 4/1996 |
| JP | 08107816 | 4/1996 |
| JP | 2000-296734 | 10/2000 |
| JP | 2000296734 | 10/2000 |
| JP | 2004216998 | 8/2004 |
| JP | 2005-110800 | 4/2005 |
| JP | 2005110800 | 4/2005 |
| WO | WO 98/03369 | 1/1998 |
| WO | WO9803369 | 1/1998 |

* cited by examiner

CUSHION FOR BABY CHAIR

BACKGROUND OF THE INVENTION

1. Field of the Invention

The present invention relates to an attitude holding cushion provided in a seat of a baby chair.

2. Description of the Related Art

For a seat structure of a baby chair, there is well known a seat structure in which a seat having cushioning characteristics is covered with an integrated cover substantially all over the surface of the seat (for example, see Japanese Patent Application Laid-Open (JP-A) No. 8-107816). For the cushion used in an automobile child safety seat or a baby crib, there is also proposed a cushion in which all circumferences of a flat base seat are surrounded by a projection portion or a wall portion (for example, see JP-A No.2000-296734).

In the seat structure disclosed in JP-A, No. 8-107816, little infant attitude holding effect can be expected because an infant support surface is formed in a substantially flat shape. In the cushion disclosed in JP-A No. 2000-296734, there is high infant protection effect against a shock because the projection portion or the wall portion is provided so as to surround the infant. However, because the baby chair is used to temporarily lay the infant down or to seat the infant indoors, the high shock cushioning effect is not required for the cushion of the baby chair unlike the child safety seat. The cushion of the seat of the baby chair is preferentially configured to hold the infant in a comfortable attitude. Furthermore, because the baby chair is used in a relatively wide range of a newborn baby to a child of the age of about four, it is necessary that the attitude holding function be appropriately changed according to growth of the infant.

SUMMARY OF THE INVENTION

In view of the foregoing, an object of the invention is to provide a cushion having an attitude holding function suitable for the baby chair.

The present invention achieves the above-described object by a cushion for baby chair comprising; a head pad, a back pad and a buttocks pad which are arranged on a seat of the baby chair to support a head, a back and a buttocks of the infant respectively, wherein the head pad is configured to support the head of the infant by a neck support portion projecting along a lower edge of the head pad and a pair of temporal support portions projecting along both side edges of the head pad, the back pad is configured to support a trunk of the infant from a side by a pair of trunk support portions projecting along both side edges of the back pad and extending from an upper edge to a lower edge of the back pad, the buttocks pad is configured to support a buttocks of the infant by a buttocks support portion projecting along a lower edge of the buttocks pad, and the buttocks pad is configured to support a thigh and a knee of the infant by a pair of thigh support portions projecting along both side edge of the buttocks pad, and the head pad, the back pad, and the buttocks pad are made to be couplable with and separatable from one another.

According to the cushion of the present invention, firstly, by supporting the infant head with the neck support portion, the infant head can be held in the attitude in which an infant jaw is raised in some degree. Thereby, the oppression of an infant airway can be prevented to cause the infant to take breath without any difficulty. The infant head can be orientated toward the front face while the side toppling and side shift of the head are prevented by putting the temporal support portion to the infant head from the side. The side shift of an infant trunk can be prevented by supporting the infant trunk from the side with the trunk support portions of the back pad. The trunk support portion is extended from the lower edge to the upper edge of the back pad, so that the side-shift prevention effect can be enhanced. The shift of the buttocks toward the front of the seat can be suppressed by putting the buttocks support portion of the buttocks pad to the infant buttocks. Thereby, abdominal part curvature and oppression caused by the forward shift of the buttocks can be prevented. The thigh support portion of the buttocks pad supports the range from the thigh to the knee of the infant from the side, which allows the infant knee to be properly folded inside to hold the lower extremity toward a proper orientation. Therefore, a balance between a flexor and an extensor of a lower part of the infant is properly maintained to prevent deformation or atrophy of the body. Because the lower extremity can be orientated toward an appropriate direction by putting the thigh support portion of the buttocks pad to the outside of the knee, it is not necessary that the infant lower extremity be surrounded over all the circumferences, and a degree of freedom for the leg movement of the infant can relatively easily be enhanced. The head pad, the back pad, and the buttocks pad is couplable with and separatable from one another, so that only the necessary pad can be used by arranging the pad on the seat according to the growth of the infant. Therefore, the baby chair is used in the wide range of applicable ages, and the proper attitude holding function can be obtained easily and securely according to the growth of the infant.

According to one embodiment of the present invention, an edge line of the neck support portion may be curved about a height direction so as to draw a concave curve line whose bottom is a central portion in a right and left direction of the head pad. The infant rear neck can naturally be positioned in the center in the right and left direction of the head pad to prevent the side shift of the head by imparting the curvature to the neck support portion.

According to one embodiment of the present invention, a support surface may be provided on an inner periphery of the temporal support portion, the support surface being extended drawing a down slope toward a recess portion surrounded by the neck support portion and the temporal support portion. The temporal support portion can support the temporal region of the infant in the wide range to naturally orientate the head toward the front face by providing the support surface.

According to one embodiment of the present invention, an edge line of the temporal support portion may be gradually lowered toward the upper edge side of the head pad. Thereby, a feeling that the head is surrounded by the temporal support portion is reduced to enhance open-feeling of the infant.

According to one embodiment of the present invention, a projection portion does not exist in at least a central portion of the upper edge of the head pad, thereby the recess portion surrounded by the neck support portion and the temporal support portion is opened to the upper edge side of the head pad. According to the mode, the open-feeling of the infant is enhanced because the projection portion which constrains the parietal region of the infant does not exist.

According to one embodiment of the present invention, a height of the trunk support portion of the back pad is gradually decreased from the lower edge side toward the upper edge side of the back pad. When the height of the trunk support portion is changed in the above-described way, the vicinity of an infant lumber is deeply supported by the trunk support portion, and the vicinity of an infant shoulder is lightly supported by the trunk support portion, which allows the degree of freedom to be enhanced in arm movement of the infant.

According to one embodiment of the present invention, an edge line of the buttocks support portion of the buttocks pad may be curved about the height direction so as to draw a concave curve line whose bottom is a central portion of the right and left direction of the buttocks pad. The infant lower extremity can securely be orientated toward the inside by imparting the curvature to the edge line of the buttocks support portion. When the buttocks support portion and the pair of thigh support portions are integrally connected, the recess portion surrounded by the buttocks support portion and the thigh support portion is generated on the buttocks pad to enhance the positioning effect of the buttocks accepted by the recess portion, which allows the side-shift of the buttocks to be securely prevented. When the trunk support portion and the thigh support portion are continued with the back pad and the buttocks pad coupled, even if the back pad and the buttocks pad are configured to be separatable, the projection portion, which is continued in a hill-shape from the thigh support portion to the trunk support portion as if the back pad and the buttocks pad are integrated, is generated, thereby the side shift of the infant trunk can securely be prevented while supporting the infant more naturally. Particularly, when the trunk support portion and the thigh support portion are continued such that an edge line of the thigh support portion is located on extension of the edge line of the trunk support portion, a sense of unity of the back pad and the buttocks pad can further be enhanced. When inclined surface are formed in each facing end portions of the trunk support portion and the thigh support portion, a gap is generated between the facing portions of the trunk support portion and the thigh support portion, thereby the cushion can easily be folded between the back pad and the buttocks pad. Accordingly, even if the seat of the baby chair comprises the reclining mechanism, the resistance of the cushion is reduced to easily perform the reclining operation.

According to one embodiment of the present invention, a coupling portion between the head pad and the back pad may be configured such that the head pad becomes adjustable in position in an up and down direction of the seat with respect to the back pad. According to the mode, the infant head can be supported at the optimum position by changing the position of the head pad according to the position of the infant head.

According to one embodiment of the present invention, the cushion may comprise a cover with which the coupling portion between the head pad and the back pad, and a coupling portion between the back pad and the buttocks pad are covered. When such a cover is provide, because the gap does not exists in the coupling portion between the pads, the same attitude holding effect or cushioning effect as the integrated cushion can apparently be obtained even if the cushion has the divided structure.

BRIEF DESCRIPTION OF THE DRAWINGS

In the drawings attached.

DETAILED DESCRIPTION OF THE PREFERRED EMBODIMENTS

Figure 1:
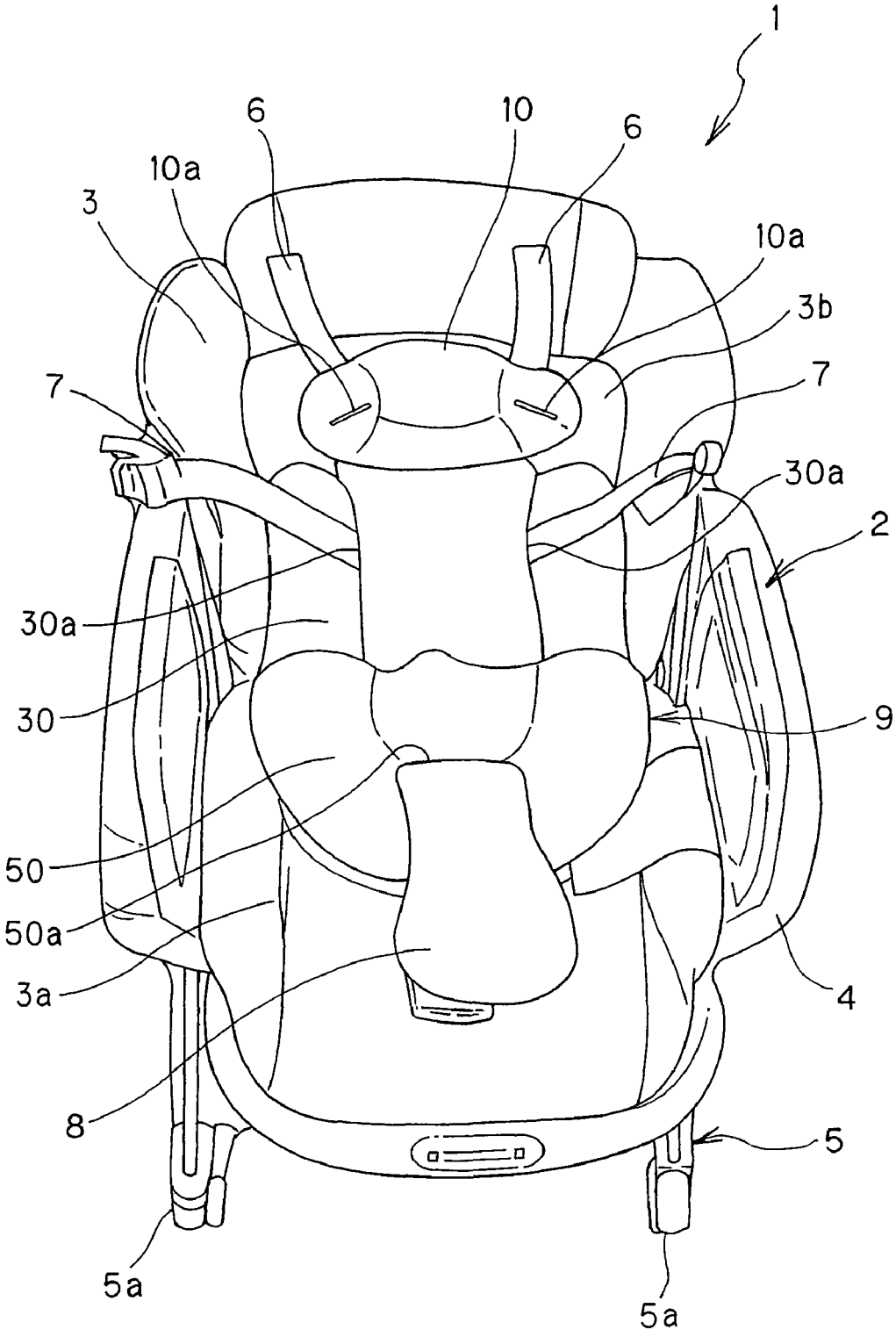
FIG. 1 is a front perspective view showing a baby chair to which a cushion according to an embodiment of the invention is applied when obliquely viewed from above.

A cushion for a baby chair according to a preferred embodiment of the invention will be described below. FIG. 1 shows a baby chair when obliquely viewed from above. A baby chair 1 comprises a chair main body 2 and a seat 3 attached to the chair main body 2. The chair main body 2 comprises a seat support portion 4 and a foldable leg portion (only a part is shown in FIG. 1) 5 which supports the seat support portion 4. The seat 3 is formed by covering a base plate or a cushioning material, which is or a core material, with a cover made of cloth or the like. A reclining mechanism (not shown) which changes inclination of a back portion 3B with respect to seat portion 3*a* of the seat 3 is provided in the seat support portion 4. The reclining mechanism may have the same configuration as the well-known baby chair. A shoulder belt 6, a lumber belt 7, and a crotch belt 8 which constrain the infant are provided on the seat 3. A caster 5*a* is attached to a front end of the leg portion 5.

Figure 2:
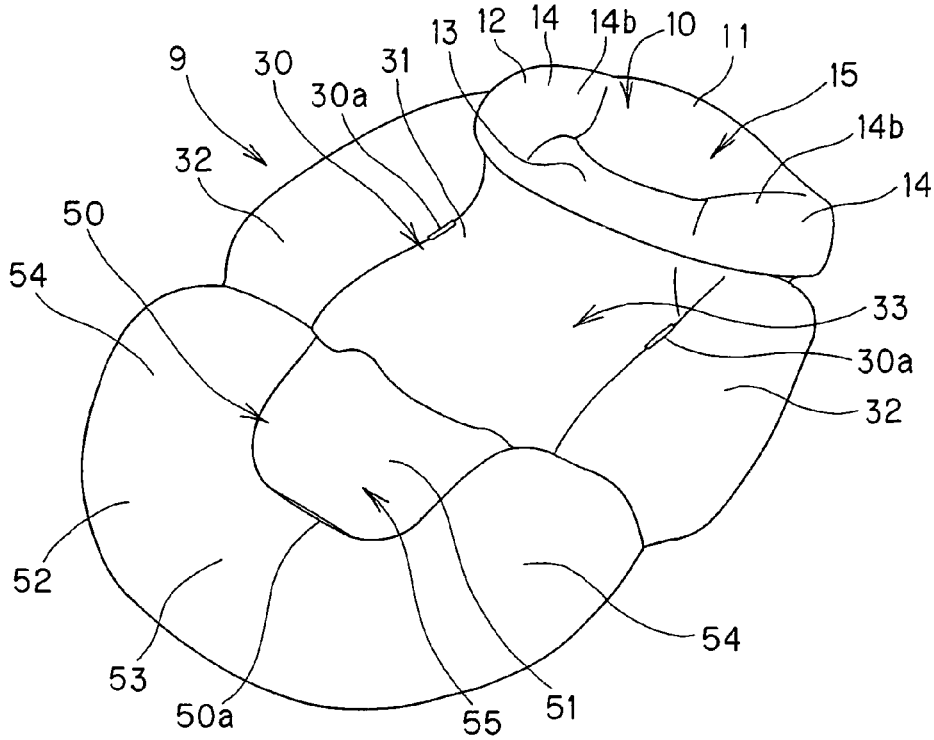
FIG. 2 is a perspective view showing a cushion according to an embodiment of the invention.
Figure 3:
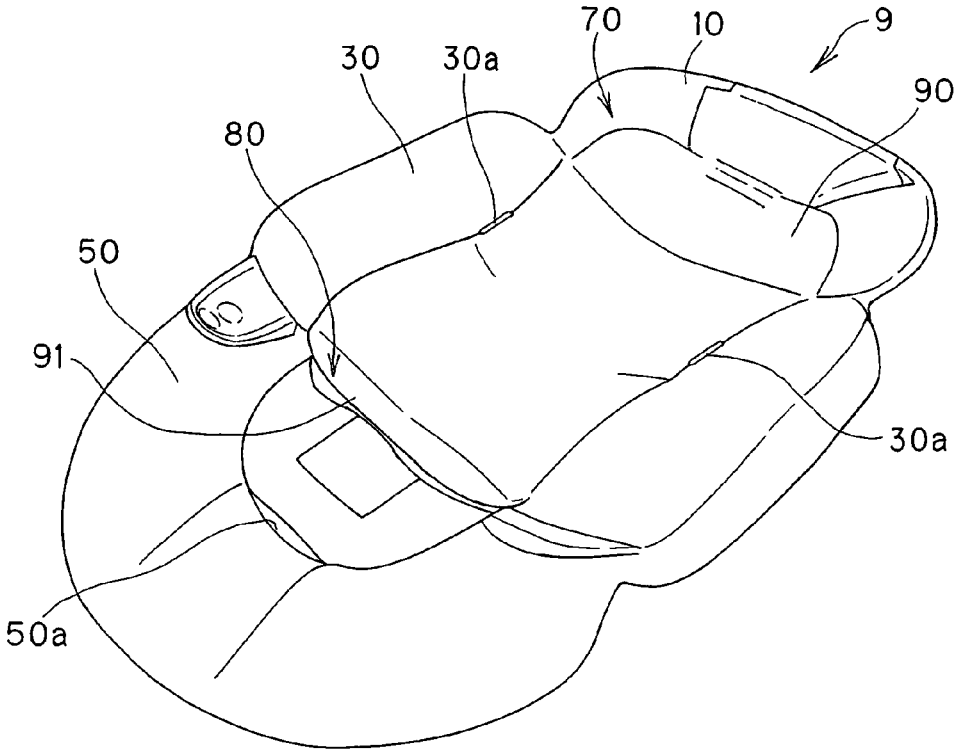
FIG. 3 is a perspective view showing a state in which the cushion is turned over.
Figure 4:
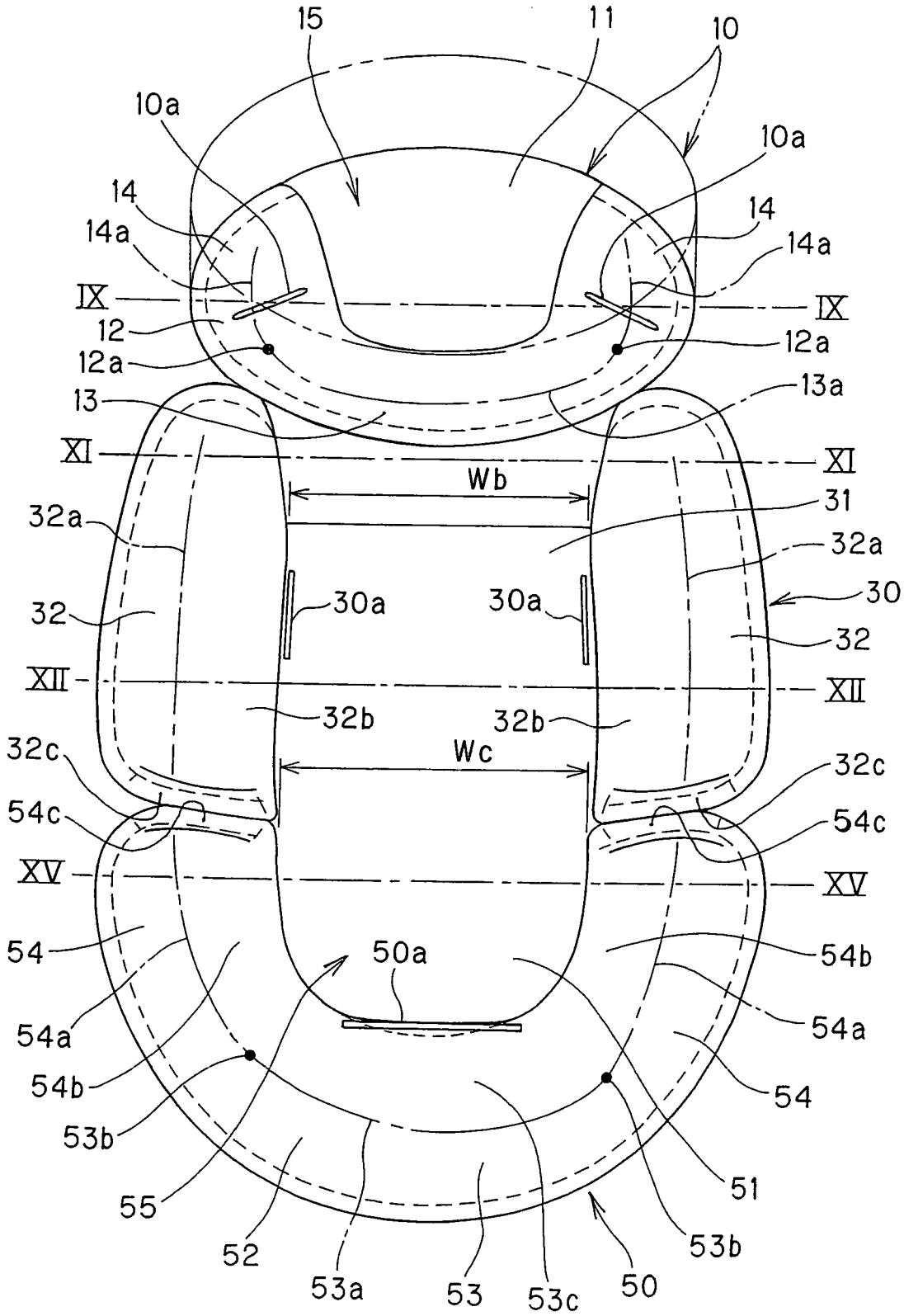
FIG. 4 is a plan view of the cushion.
Figure 5:
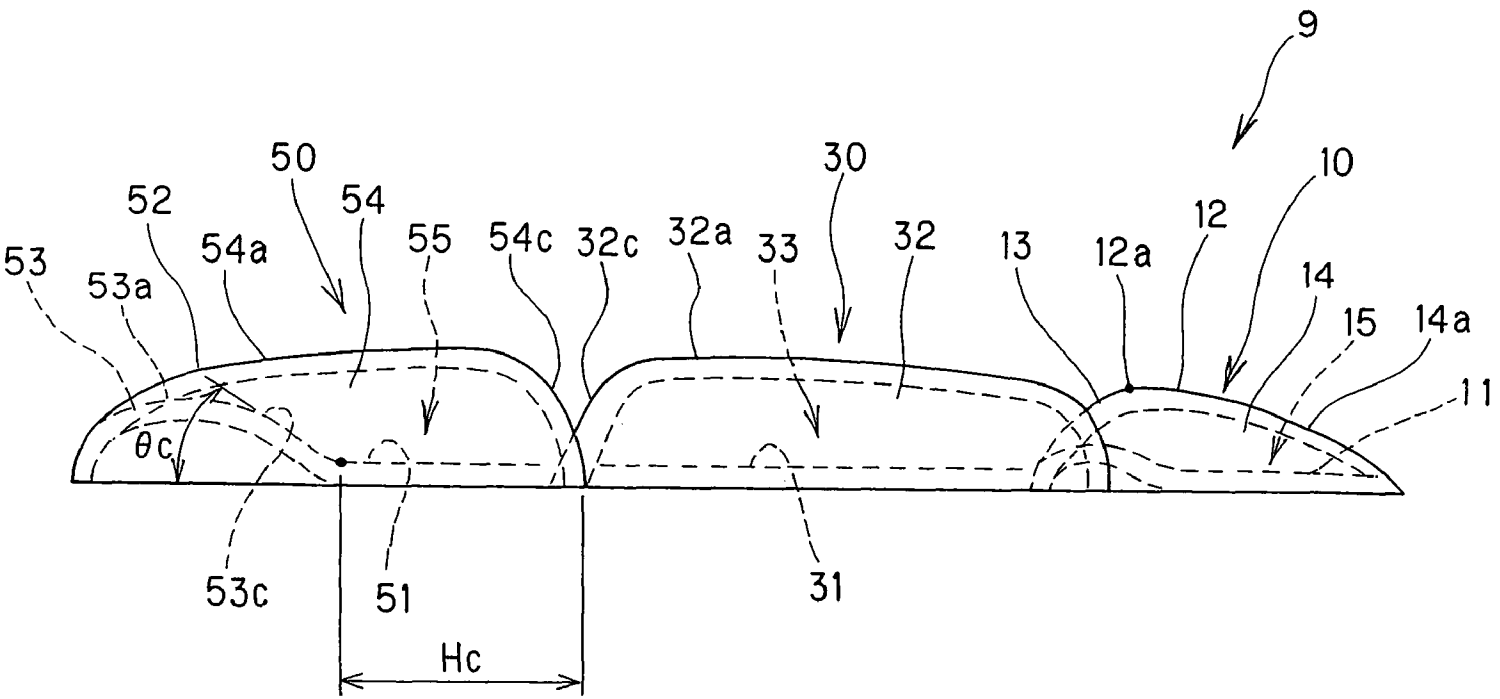
FIG. 5 is a right side view of the cushion.

A cushion 9 according to an embodiment of the invention is provided on the seat 3. FIG. 2 is a perspective view of the cushion 9, FIG. 3 is a perspective view showing a state in which the cushion 9 is turned over, FIG. 4 is a plan view of the cushion 9, and FIG. 5 is a right side view of the cushion 9. As shown in FIGS. 2 to 5, the cushion 9 includes a head pad 10, a back pad 30, and a buttocks pad 50. The head pad 10 is provided to support the infant head, the back pad 30 is provided to support the infant back, and the buttocks pad 50 is provided to support the infant buttocks. These pads 10, 30, and 50 are individually formed in an independent component. As shown in FIG. 3, the head pad 10 and the back pad 30 are coupled to each other through a coupling portion 70, and the back pad 30 and the buttocks pad 50 are coupled to each other through a coupling portion 80. As shown by an imaginary line in FIG. 4, the position of the head pad 10 can be adjusted in a longitudinal direction of the seat 3 with respect to the back pad 30.

As can be seen from FIG. 1, belt through holes 10*a*, 30*a*, and 50*a* are provided on the pads 10, 30, and 50 respectively. The head pad 10 is attached on to the seat 3 by passing the shoulder belt 6 through the belt through hole 10*a*, the back pad 30 is attached onto the seat 3 by passing the lumber belt 7 through the belt through hole 30*a*, and the buttocks pad 50 is attached onto the seat 3 by passing the crotch belt 8 through the belt through hole 50*a*.

As shown in FIGS. 2, 4, 6, and 7, the head pad 10 comprises a base seat 11 and a projection portion 12 provided along an outer periphery of the base seat 11. The base seat 11 is formed in a flat shape while the outer periphery of the base seat 11 has roundness. The projection portion 12 comprises a neck support portion 13 and a pair of temporal support portions 14. The neck support portion 13 is extended along the lower edge of the head pad 10, and the pair of temporal support portions 14 is extended along both side edges of the head pad 10. The neck support portion 13 is provided to support the infant rear neck, and the temporal support portion 14 is provided to support the infant head from the side. The neck support portion 13 and the temporal support portion 14 are integrally provided such that edge lines 13*a* and 14*a* of the neck support portion 13 and temporal support portion 14 are connected to each other in a U-shape when viewed from above. The temporal support portion 14 is extended to a position where the temporal support portion 14 substantially reaches the upper edge of the head pad 10, and the projection portion 12 does not exist in at least the center of the upper edge of the head pad 10. Therefore, a recess portion 15 is generated on the base seat 11. In the recess portion 15, the lower edge and side edges are surrounded by the projection portion 12 while the upper edge side is opened. The recess portion 15 functions as a portion which accepts the infant head.

Figure 7:
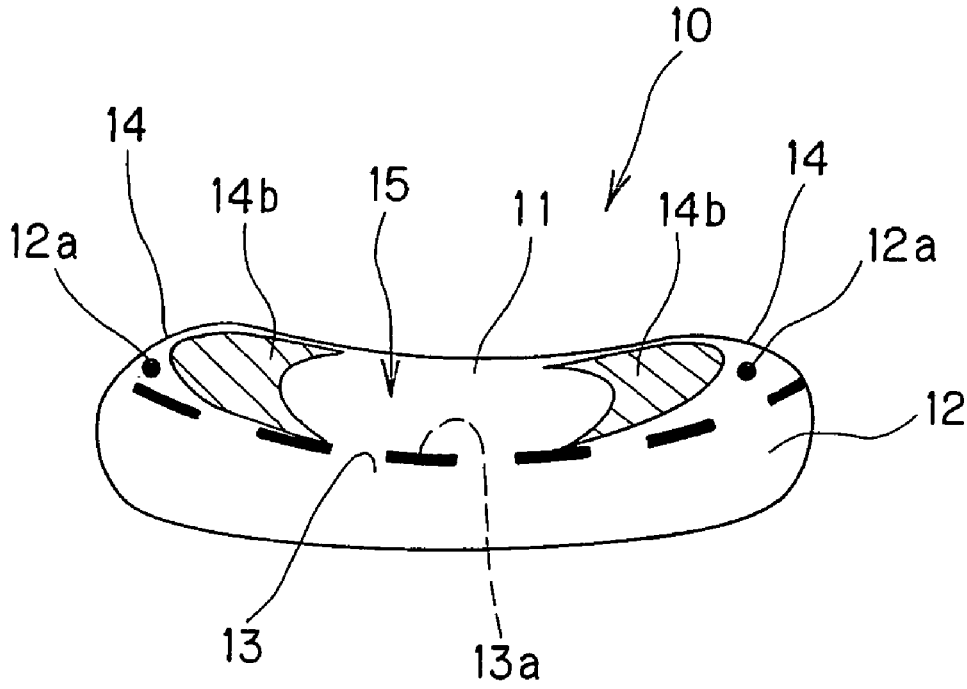
FIG. 7 shows a state of the head pad on a lower edge side when obliquely viewed from above.
Figure 8:
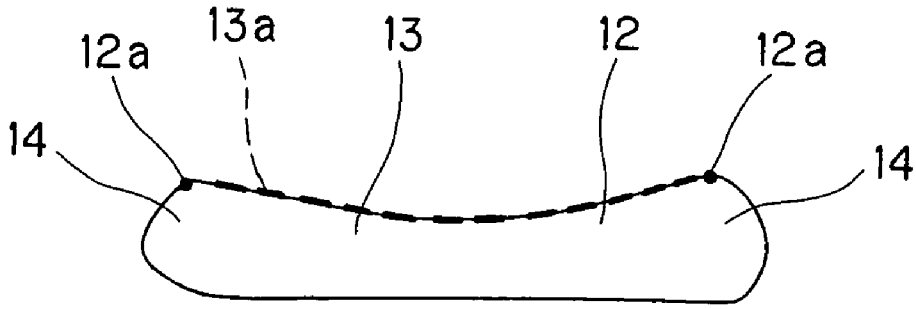
FIG. 8 is a side view showing the head pad when viewed from an arrow VIII direction of FIG. 6.

As shown by broken lines in FIGS. 7 and 8, the edge line 13*a* of the neck support portion 13 is curved in a height direction (thickness direction of the head pad 10) so as to draw a concave curved line whose bottom is a center portion in the right and left direction of the head pad 10. As can be seen from FIG. 4, the edge line 14*a* of the temporal support portion 14 is continuously connected to both ends of the edge line 13*a* of the neck support portion 13, and the edge line 14*a* is extended toward the upper edge of the head pad 10 drawing an arc swollen outward to some extent. As can be seen from FIG. 5, the edge line 14*a* of the temporal support portion 14 is inclined so as to be gradually lowered from a vertex 12*a* toward the upper edge side (right in FIG. 5) of the head pad 10. The vertex 12*a* is located in the connection portion of the edge line 14*a* and the edge line 13*a* of the neck support portion 13. A front end of the temporal support portion 14 has the substantially same height as the base seat 11. That is, the projection portion 12 of the head pad 10 has the vertex 12*a* at a boundary position between the neck support portion 13 and the temporal support portion 14, and the height of the projection portion 12, i.e., an amount of projection from the base seat 11 is decreased as the projection portion 12 is separated away from the vertex 12*a* along the edge lines 13*a* and 14*a*.

Figure 6:
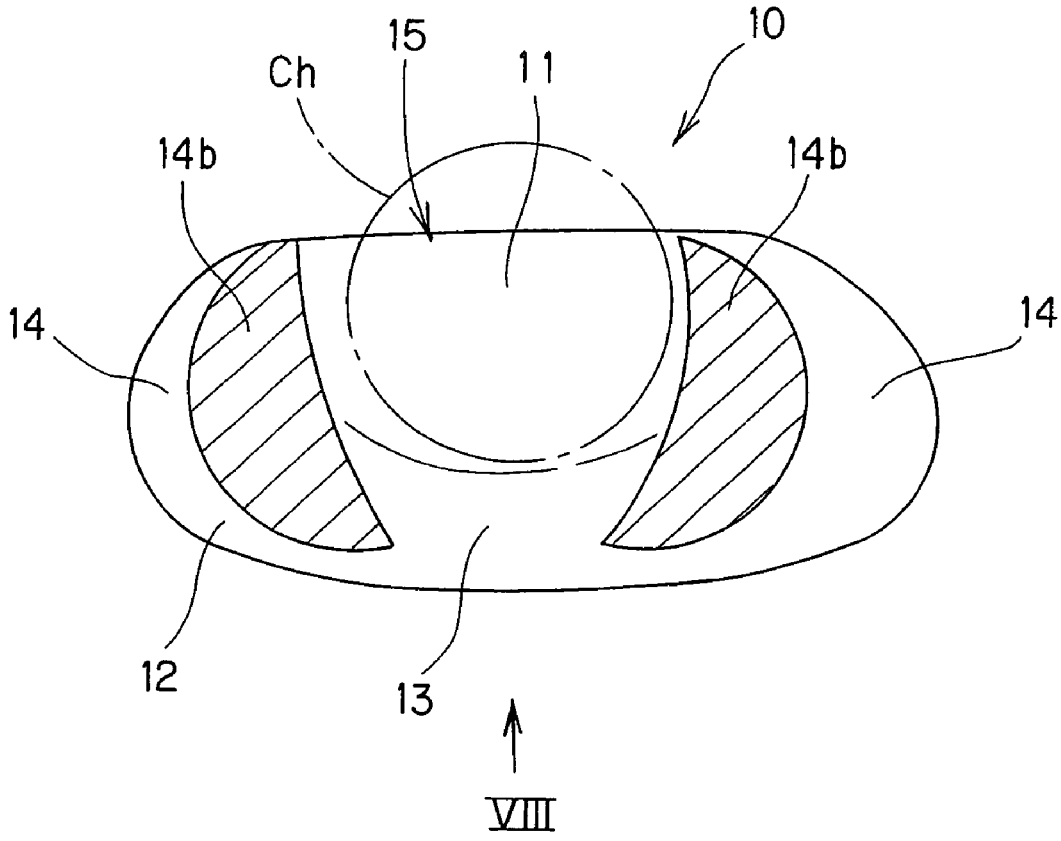
FIG. 6 is a plan view of a head pad.
Figure 9:
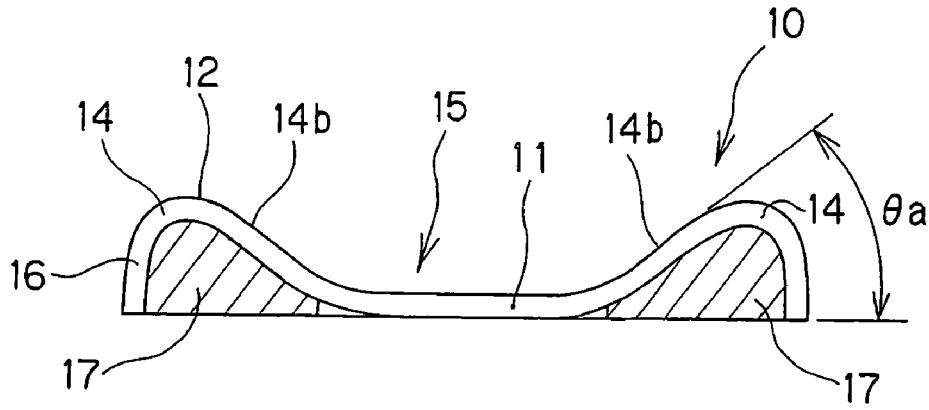
FIG. 9 is a sectional view of the head pad taken on line IX-IX of FIG. 4.

As shown by hatch lines in FIGS. 6 to 7, a support surface 14*b* which draw a downslope toward the recess portion 15 is provided on an inner periphery of the temporal support portion 14, i.e., in a region located inside the edge line 14*a*. As shown in FIG. 9, the support surface 14*b* functions as an inclined surface which laterally supports the infant head accepted in the recess portion 15. The support surface 14*b* may be formed in the inclined surface having the constant inclination, or the support surface 14*b* may be recessed in a bowl shape.

Dimensions such as the height of the projection portion 12, the inclined angle of the support surface 14*b*, and a size of the recess portion 15 can appropriately be determined according to a physical size of the infant which is of the target of the baby chair 1. However, desirably the height of the neck support portion 13 is adjusted to the projection amount of the occipital region based on the infant rear neck, and desirably a width of the recess portion 15 is adjusted to the size of the occipital region. Only as a guide, based on the surface of the base seat 11, i.e., a bottom surface of the recess portion 15, the height of the vertex 12*a* of the projection portion 12 can be set at about 30 mm, the minimum height (the height in the center portion) of the neck support portion 13 can be set at about 9 mm, and an inclined angle θa can be set at about 39° with respect to a horizontal direction of the support surface 14*b* shown in FIG. 9. As shown by the imaginary line in FIG. 6, the size of the recess portion 15 can be set so as to ensure a flat circular area Ch having the diameter of about 107 mm. As shown in FIG. 9, the projection portion 12 of the head pad 10 is formed by providing an elastic material having the proper cushioning characteristics inside a skin material 16. The elastic material is provided as an interior material 17. A material such as mesh textile having an aeration property or a material in which through holes are additionally made in a raw material such as cloth having the poor aeration property to ensure the aeration property can be used as the skin material 16. The elastic material such as cotton, urethane, low-repulsion urethane, and gel can be used as the interior material 17. The aeration property may be formed in the interior material 17, and a urethane raw material having coupled bubbles may be used as the interior material 17. However, the interior material 17 may be provided in both the base seat 11 and the projection portion 12.

Figure 10:
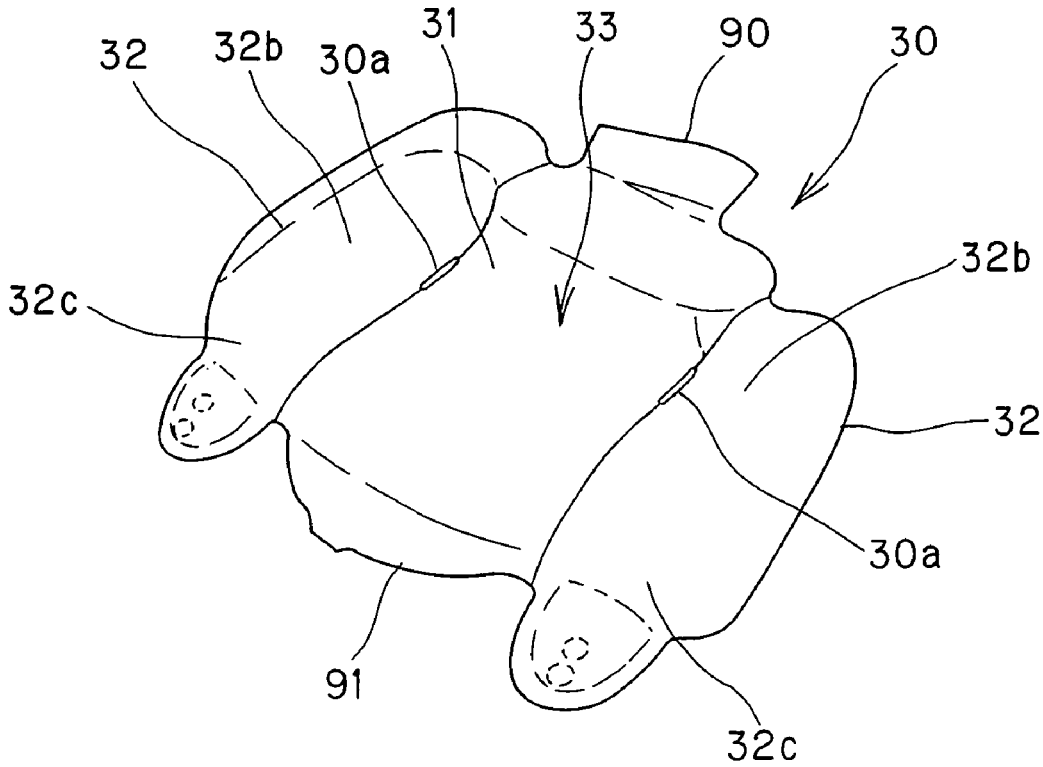
FIG. 10 is a perspective view of a back pad.

As shown in FIGS. 2, 4, and 10, the back pad 30 includes a base seat 31 and a pair of trunk support portions 32 which is arranged at both ends in the right and left direction of the base seat 31. The base seat 31 is formed in a flat shape like the base seat 11 of the head pad 10. Each of the hill-shape trunk support portions 32 is extended from the upper edge to the lower edge of the back pad 30 while projecting along both side edges of the back pad 30. Thereby, a recess portion 33, upper edge side and the lower edge side there of are opened respectively, is generated on the base seat 31. The recess portion 33 functions as a portion which accepts the infant back. As shown in FIG. 4, an edge line 32*a* of the trunk support portion 32 is extended substantially straight from the upper edge to the lower edge. As shown in FIG. 5, the edge line 32*a* of the trunk support portion 32 is inclined so as to draw the downslope from the lower edge toward the upper edge of the back pad 30. That is, the height of the trunk support portion 32 is gradually decreased from the lower edge toward the upper edge of the back pad 30.

Figure 11:
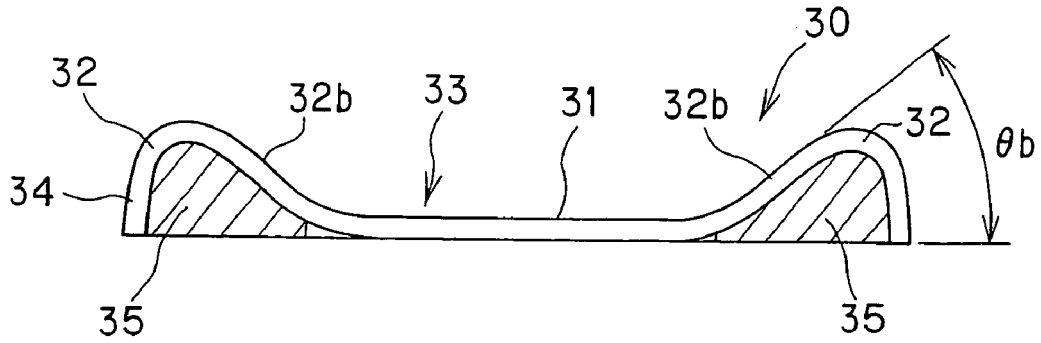
FIG. 11 is a sectional view of the back pad taken on line XI-XI of FIG. 4.
Figure 12:
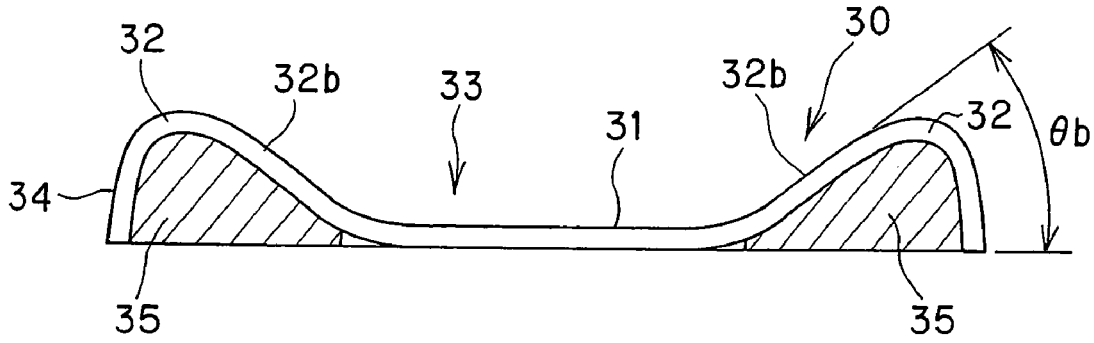
FIG. 12 is a sectional view of the back pad taken on line XII-XII of FIG. 4.

As shown in FIGS. 11 and 12, a support surface 32*b* drawing the downslope toward the recess portion 33 is provided on a region located inside the edge line 32*a* of the back pad 30. The support surface 32*b* functions as the inclined surface which supports the infant, accepted by the recess portion 33, from the side. The support surface 32*b* may be formed in the inclined surface having the constant inclination, or the support surface 32*b* may be curved in a convex or concave shape. As shown in FIG. 5, an inclined surface 32*c* is provided on the end portion on the lower edge side (left end side in FIG. 5) of the trunk support portion 32. The inclined surface 32*c* is provided to avoid interference of the trunk support portion 32 and the buttocks pad 50 when the back portion 3*b* is raised with respect to the seat portion 3*a* in the seat 3 of the baby chair 1.

The size of the trunk support portion 32 can appropriately be determined according to the physical size of the infant which is of the target of the baby chair 1. However, desirably the size and position of the trunk support portion 32 are provided such that the trunk support portion 32 properly supports the infant from the side. Only as a guide, based on the surface of the base seat 31, the maximum height of the trunk support portion 32 can be set at about 40 mm, the minimum height of the trunk support portion 32 can be set at about 30 mm, and the inclined angle θb shown in FIGS. 11 and 12 can be set at about 39° with respect to the horizontal direction of the support surface 32*b* of the trunk support portion 32. A minimum width Wb (see FIG. 4) in the flat portion of the recess portion 33 can be set at about 147 mm, and a width Wc (see FIG. 4) of the recess portion 33 in the back pad 30 can be set at about 156 mm. As shown in FIGS. 11 and 12, the trunk support portion 32 of the back pad 30 is formed by providing an elastic material having the proper cushioning characteristics, as an interior material 35, in a skin material 34. The raw materials used for the skin material 34 and interior material 35 may be selected in the same manner as the skin material 16 and interior material 17 of the head pad 10. The interior material 35 may be provided in both the base seat 31 and the side support portion 32.

Figure 13:
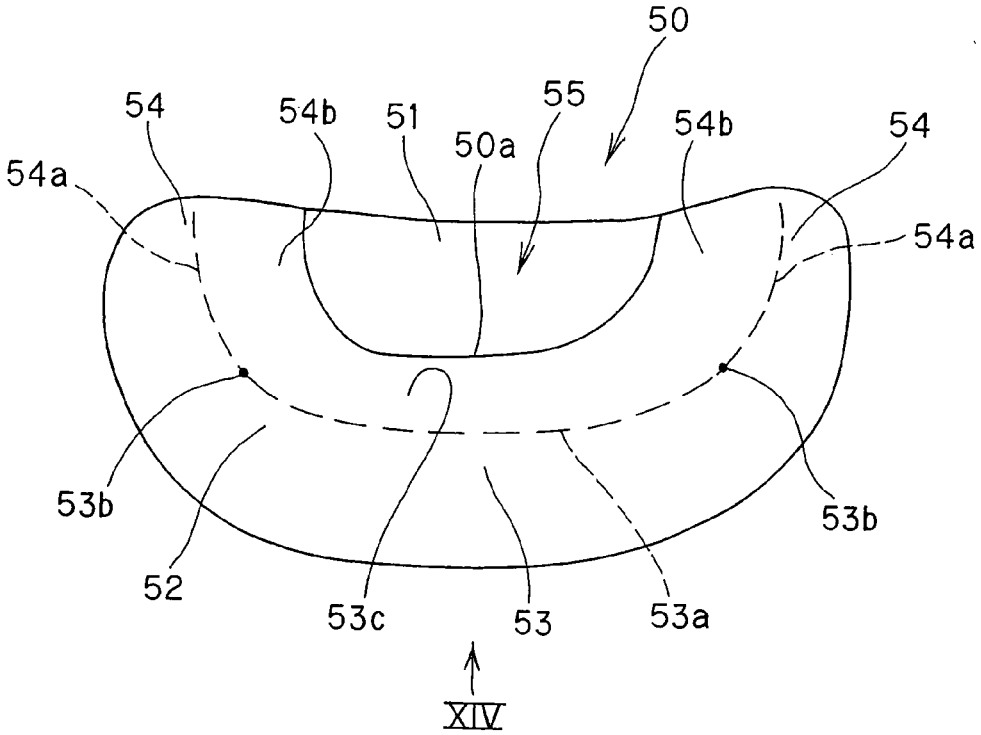
FIG. 13 shows a state of a buttocks pad on the lower edge side when obliquely viewed from above.

As shown in FIGS. 2, 4, and 13, the buttocks pad 50 comprises a base seat 51 and a projection portion 52 provided along the outer periphery of the base seat 51. The base seat 51 is formed in the flat shape like the base seats 11 and 31 of the head pad 10 and back pad 30. The projection portion 52 comprises a buttocks support portion 53 and a pair of thigh support portions 54. The buttocks support portion 53 is projecting along the lower edge of the buttocks pad 50, and the thigh support portions 54 are projected in both side edges of the buttocks pad 50. The buttocks support portion 53 is provided to support the infant buttocks, and the thigh support portion 54 is provided to support an infant tight from the side. The buttocks support portion 53 and the thigh support portion 54 are integrally provided such that edge lines 53*a* and 54*a* of the buttocks support portion 53 and thigh support portion 54 are connected to each other in a U-shape when viewed from above. The thigh support portion 54 is terminated at a position where the thigh support portion 54 substantially reaches the upper edge of the buttocks pad 50, and the projection portion 52 does not exist in at least the center of the upper edge of the buttocks pad 50. Thereby, a recess portion 55, the lower edge and side edges there of are surrounded by the projection portion 52 while the upper edge side is opened, is generated on the base seat 51. The recess portion 55 functions as a portion which accepts the infant buttocks. As shown in FIG. 4, when the back pad 30 and the buttocks pad 50 are coupled to each other, the thigh support portion 54 is continuously connected to the trunk support portion 32 of the back pad 30, and the edge line 54*a* of the thigh support portion 54 is located on an extension of the edge line 32*a*.

Figure 14:
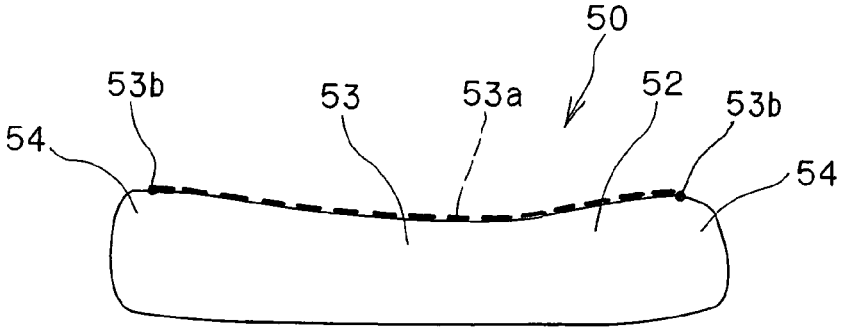
FIG. 14 is a side view of the buttocks pad when viewed from an arrow XIV of FIG. 13.

As shown by the broken line in FIG. 14, the edge line 53*a* of the buttocks support portion 53 is curved about the height direction (thickness direction of the buttocks pad 50) so as to draw a concave curved line whose bottom becomes the center portion in the right and left direction of the buttocks pad 50, and vertexes 53*b* of the buttocks support portion 53 are located at both ends of the edge line 53*a*. As can be seen from FIG. 5, the edge line 54*a* of the thigh support portion 54 is slightly inclined so as to draw an uphill gradient from the vertex 53*b* of the buttocks support portion 53 toward the upper edge side (right in FIG. 5) of the buttocks pad 50, and the height of the edge line 54*a* at the front end (end portion on the upper edge side) is substantially equal to the height of the trunk support portion 32 in the lower edge of the back pad 30.

Figure 15:
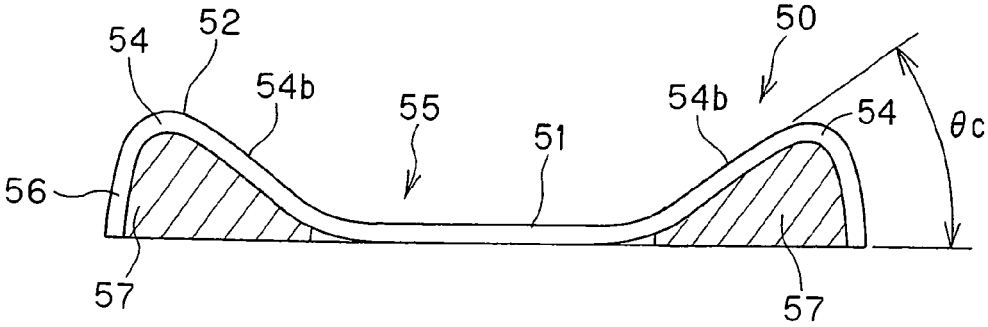
FIG. 15 is a sectional view of the buttocks pad taken on line XV-XV of FIG. 4.

As shown in FIGS. 13 and 15, a support surface 54*b* drawing the downslope toward the recess portion 55 is provided on a region located inside the edge line 54*a* of the thigh support portion 54. The support surface 54*b* functions as the inclined surface which supports the infant, accepted by the recess portion 55, from the side in the range of the buttocks to the knee through the thigh. The support surface 54*b* may be formed in the inclined surface having the constant inclination, or the support surface 54*b* may be recessed in the bowl shape. As shown in FIGS. 5 and 13, a support surface 53*c* drawing the downslope toward the recess portion 55 is provided on a region located inside the edge line 53*a* of the buttocks support portion 53. The support surface 53*c* functions as the inclined surface which supports the infant buttocks accepted by the recess portion 55, more particularly a surface of a diaper attached to the buttocks from below. As shown in FIG. 5, an inclined surface 54*c* is provided on the end portion on the upper edge side (right end side in FIG. 5) of the thigh support portion 54. Similarly to the inclined surface 32*c* of the back pad 30, the inclined surface 54*c* is provided to avoid interference of the trunk support portion 32 and the buttocks pad 50 when the back portion 3*b* is raised with respect to the seat portion 3*a* in the seat 3 of the baby chair 1.

The dimensions such as the height of the projection portion 52 and the inclined angles of the support surfaces 53*c* and 54*b* can appropriately be determined according to the physical size of the infant which is of the target of the baby chair 1. However, desirably the height of the buttocks support portion 53 is set to a level such that the buttocks support portion 53 can accept the infant buttocks and, at the same time, such that an infant lower extremity can naturally surmount the buttocks support portion 53. Desirably the height and position of the thigh support portion 54 are set such that the thigh support portion 54 comes into contact with the thigh and knee of the infant from the outside and, at the same time, such that the infant knee does not exceed the thigh support portion 54 to slip to the outside in the right and left direction. Only as a guide, based on the surface of the base seat 51, the center height of the buttocks support portion 53 can be set at about 13 mm, the maximum height of the thigh support portion 54 can be set at about 43 mm, and the inclined angle θc (see FIGS. 5 and 15) can be set at about 39° with respect to the horizontal direction of each of the support surfaces 53*c* and 54*b*. A width Wc (see FIG. 4) of the recess portion 55 in the upper edge of the buttocks pad 5 can be set at about 156 mm which is equal to the width Wc of the recess portion 33 of the back pad 30, and a height Hc (see FIG. 5) of the recess portion 55 can be set at about 160 mm. As shown in FIG. 15, the projection portion 52 of the buttocks pad 50 is formed by providing an elastic material having the proper cushioning characteristics, as an interior material 57, in a skin material 56. The raw materials of the skin material 56 and interior material 57 may be selected in the same manner as the skin material 16 and interior material 17 of the head pad 10. The interior material 57 may be provided in both the base seat 51 and the projection portion 52.

Figure 16:
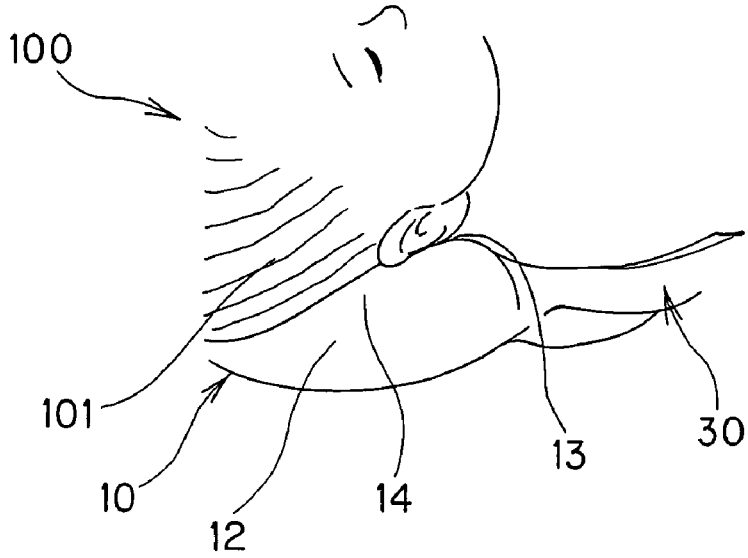
FIG. 16 shows a state in which a neck support portion of the head pad supports an infant rear neck.
Figure 17:
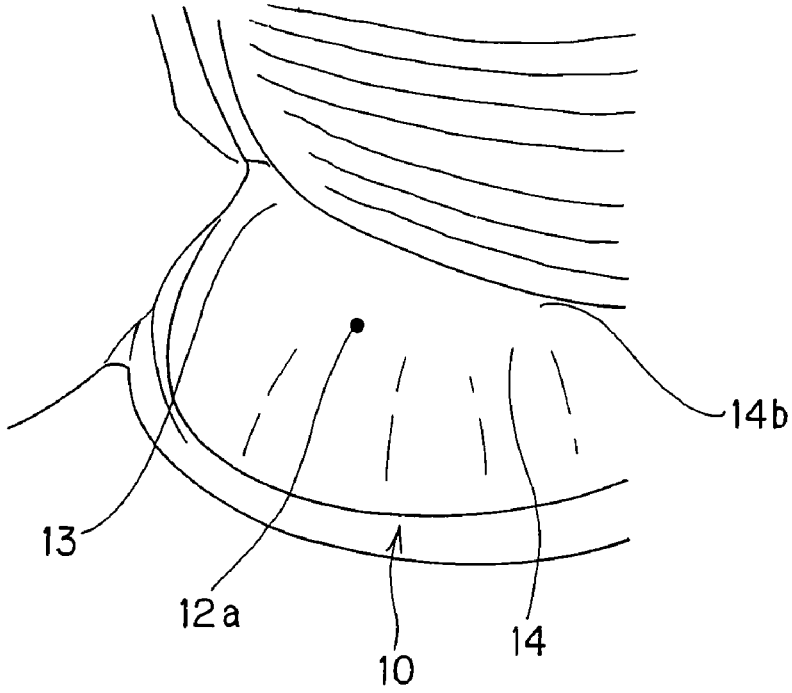
FIG. 17 shows a state in which a temporal support portion of the head pad supports an infant temporal region.

When the infant is laid down on or seated in the seat 3, the function of the cushion 9 will be described below. In the head pad 10, the infant head is accepted and supported by recess portion 15. In this case, as shown in FIG. 16, the neck support portion 13 of the head pad 10 is put to the rear neck of an infant 100 to support the neck portion from the back. Therefore, a head 101 of the infant 100 is held in an attitude in which the jaw of the infant 100 is raised in some degree, and the oppression of the airway can be prevented to cause the infant 100 to take breath without any difficulty. Because the edge line 13*a* of the neck support portion 13 is curved while drawing the concave curved line as shown in FIGS. 7 and 8, the neck portion of the infant 100 can naturally be positioned to the center in the right and left direction. As shown in FIG. 17, because the head 101 is supported by the support surfaces 14*b* of the temporal support portion 14 from both sides, the head 101 is naturally orientated toward the front face to prevent the side toppling and side shift of the head 101. These functions are particularly effective to a baby whose head is not held up yet. Because the temporal support portion 14 is gradually decreased toward the upper edge of the head pad 10, the feeling that the head 101 is surrounded by the temporal support portion 14 is reduced to enhance the open-feeling. The projection portion 12 is provided to both side edges and the recess portion 15 is opened to the upper edge side of head pad 10, so that there is no fear that a parietal region is excessively constrained by the projection portion 12. Accordingly the open-feeling is enhanced in the infant.

Figure 18:
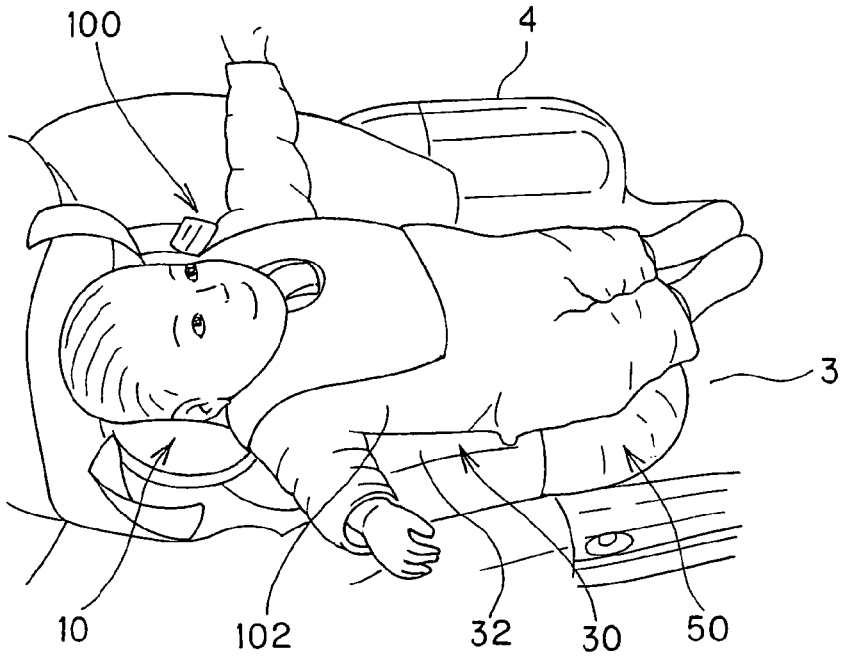
FIG. 18 shows a state in which a trunk support portion of the back pad supports an infant trunk from the side.

In the backpad 30, as shown in FIG. 18, the trunk support portion 32 is put to a trunk 102 of the infant 100 to support the trunk 102 from the outside. Thereby the side shift of the trunk of the infant 100 is prevented. The side-shift prevention effect is enhanced because the trunk support portion 32 is continuously extended from the upper edge to the lower edge of the back pad 30. As shown in FIG. 5, because the height of the trunk support portion 32 is gradually decreased from the lower edge side toward the upper edge side of the back pad 30, the trunk support portion 32 becomes higher in the infant lumber while becoming lower in the sides of the infant. Accordingly, the vicinity of the infant lumber is deeply supported to securely prevent the lumber shift by the trunk support portion 32, while the vicinity of the infant shoulder is lightly supported to enhance the degree of freedom in arm movement of the infant by the trunk support portion 32.

Figure 19:
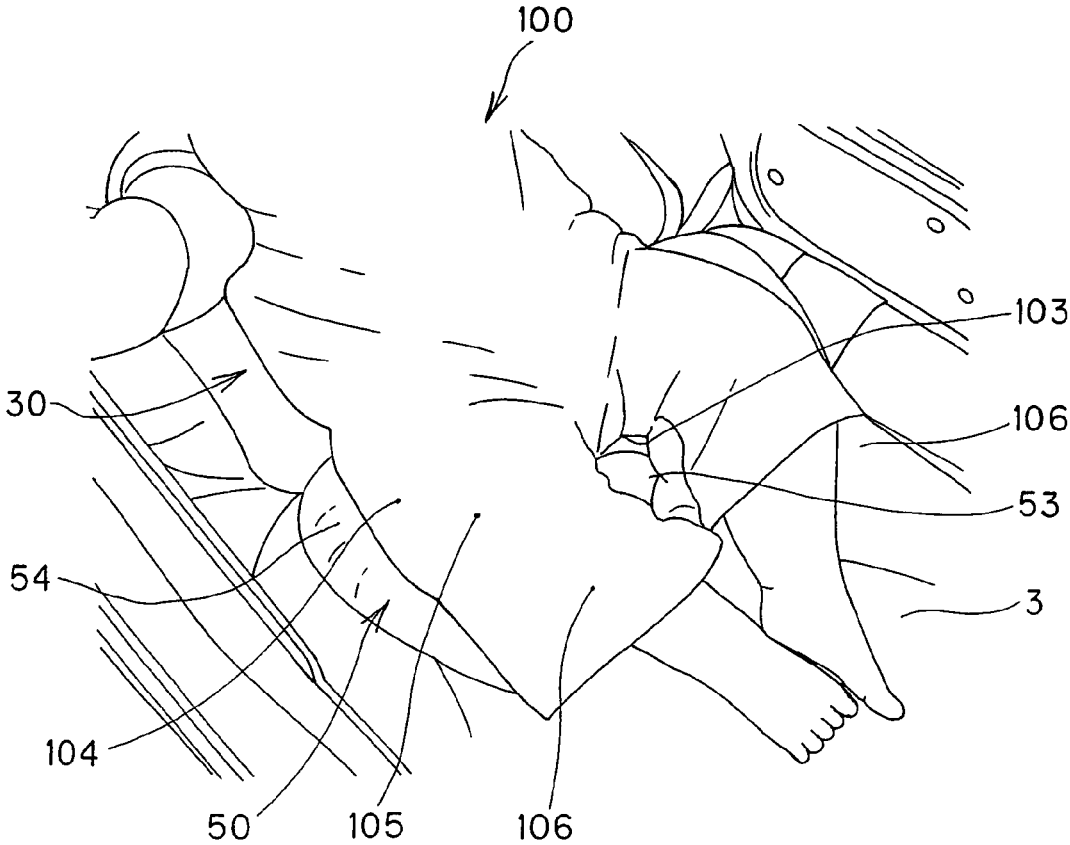
FIG. 19 shows a state in which the buttocks pad supports buttocks, a thigh, and a knee of the infant.

As shown in FIG. 19, in the buttocks pad 50, the support surface 53*c* of the buttocks support portion 53 is put to buttocks 103 of the infant 100 to support the buttocks 103. Thereby the shift of the infant 100 toward the front of the seat 3 is suppresses. Particularly, even in the case of the attitude in which the back portion of the seat is raised to seat, the infant 100, the buttocks 103 of the infant 100 is never shifted frontward. Accordingly, the abdominal part curvature and oppression caused by the forward shift of the buttocks is not generated. Furthermore, the buttocks support portion 53 and the thigh support portion 54 are integrally connected and extended at the surroundings of the recess portion 55 which accepts the buttocks 103, so that the positioning effect of the buttocks 103 of the infant is enhanced to prevent the side-shift of the buttocks 103.

In the buttocks pad 50, the thigh support portion 54 supports the region from a thigh 104 to a knee 105 of the infant, which allows the knee 105 to be properly folded inside while opening of the thigh 104 toward the outside is properly regulated. Therefore, the opening of the knee 105 toward the outside is suppressed to properly hold a lower extremity 106 toward the proper orientation. In addition, because the edge line 53*a* of the buttocks support portion 53 is curved so as to draw the concave curved line, the lower extremity 106 can be orientated more stably toward the inside. These functions properly hold the balance between the flexor and the extensor of the lower part of the infant 100 to prevent the deformation or atrophy of the body. The buttocks pad 50 is configured such that the lower extremity 106 exceeds the projection portion 52 to stretch out the lower extremity 106 toward the front of the seat 3, and the projection portion or wall portion which surrounds the lower extremity 106 does not exist. Therefore, the leg movement of the infant is not obstructed.

In the cushion 9 of the embodiment, because the back pad 30 and the buttocks pad 50 are individually provided, and the back pad 30 and the buttocks pad 50 are coupled by the coupling portion 80. Therefore, the cushion 9 can easily be folded at a boundary portion between the back pad 30 and the buttocks pad 50. When the inclination of the back portion 3*b* of the seat 3 is change, the cushion 9 does not become the resistance, and the reclining operation of the seat 3 can relatively easily be performed. The inclined surfaces 32*c* and 54*c* are provided in the facing portions of the trunk support portion 32 of the back pad 30 and the thigh support portion 54 of the buttocks pad 50, which allows the cushion 9 to be further easily folded.

In the cushion 9 of the embodiment, the head pad 10, the back pad 30, and the buttocks pad 50 is couplable with and separatable from one another, so that the pads 10, 30, and 50 can be used by appropriately selecting the pads 10, 30, and 50 according to a growing stage of the infant. In an example of the usage pattern, all the pads 10, 30, and 50 are used in a newborn baby stage (baby which is two to three months old), the back pad 30 and the buttocks pad 50 are used in an early sit-up stage. (baby which is two or three to five or six months old), only the buttocks pad 50 is used in a middle sit-up stage (baby which is five or six to eleven or twelve months old), and the cushion 9 is not used after a late sit-up stage (baby which is thirteen months old or more). The head pad 10 is configured such that the position of the head pad 10 is adjustable in an up and down direction of the seat 3 with respect to the back pad 30, so that the infant head can be supported at the optimum position by changing the position of the head pad 10 according to the infant head.

Figure 20A:
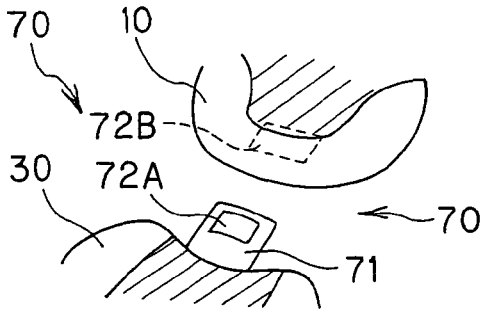
FIG. 20A shows an example in which the head pad and the back pad are coupled by a surface fastener.

The coupling portions 70 and 80 of the pads 10, 30, and 50 will be described below. FIGS. 20A to 20E show examples of the coupling portion 70 between the head pad 10 and the back pad 30. In the example, a strip-shape portion 71 is provided on the center of the upper edge of the back pad 30, and surface fasteners 72A and 72B are bonded to the surface of the strip-shape portion 71 and the backside of the head pad 10. The head pad 10 and the back pad 30 are coupled to each other by utilizing the surface fasteners 72A and 72B. In the example of FIG. 20A, the position in the up and down direction of the head pad 10 can be changed with respect to the back pad 30 by shifting the overlapping range of the surface fasteners 72A and 72B in the up and down direction of the seat 3. The position adjustment range of the head pad 10 may be enlarged by attaching the strip-shape portion 71 to the back pad 30 with the position of the strip-shape portion 71 vertically adjustable. Because the surface fastener 72B of the head pad 10 comes into contact with the skin material of the seat 3, it is desirable to form the surface fastener 72B in a female side having no hook-shape projection, i.e., a loop-side surface fast.

Figure 20B:
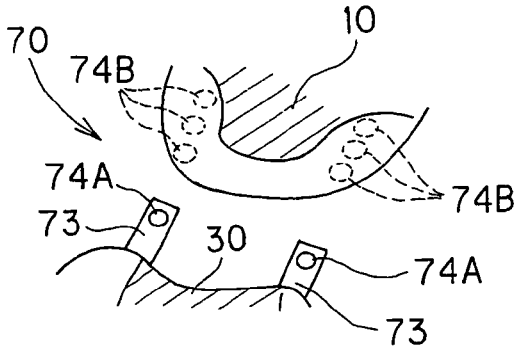
FIG. 20B shows an example in which the head pad and the back pad are coupled by a hook.

In the example of FIG. 20B, a pair of strip-shape portions 73 is provided on the upper edge of the back pad 30, a hook 74A is attached to each strip-shape portion 73, and plural hooks 74B are attached at appropriate intervals in the up and down direction. The hooks 74B can be engaged with the hook 74A located at the position corresponding to the strip-shape portion 73 in the backside of the head pad 10. In the example of FIG. 20B, the head pad 10 and the back pad 30 are coupled to each other by engaging the hook 74A of the back pad 30 with the hook 74B located at any one of the positions in the head pad 10. The position of the head pad 10 can vertically be changed with respect to the back pad 30 by changing the hook 74B which should be engaged with the hook 74A.

Figure 20C:
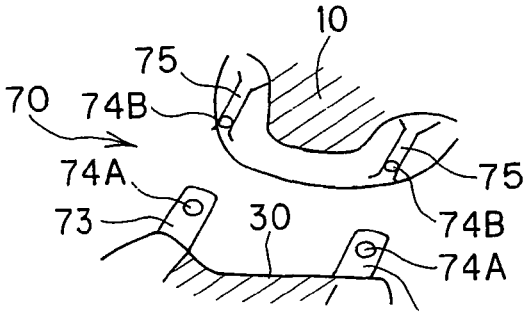
FIG. 20C shows another example in which the head pad and the back pad are coupled by the hook.

The example of FIG. 20C is similar to the example of FIG. 20B in that the head pad 10 and the back pad 30 are coupled by engaging the hook 74A with the hook 74B. However, it is different from the example of FIG. 20B in that a slide guide 75 extended in the up and down direction is provided at each position corresponding to the strip-shape portion 73 of the head pad 10, and the single hook 74B is attached to each slide guide 75 while the position of the hook 74B can vertically be adjusted. In the example, the position of the head pad 10 can be changed with respect to the back pad 30 by changing the position in the up and down direction of the hook 74B of the head pad 10.

Figure 20D:
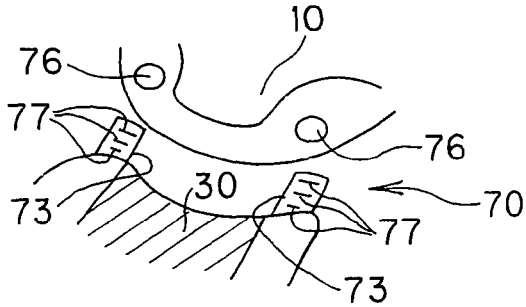
FIG. 20D shows an example in which the head pad and the back pad are coupled by a button.

In the example of FIG. 20D, a pair of buttons 76 is attached to the lower edge of the head pad 10, and plural-button holes 77 through which the button 76 is passed are vertically provided at intervals in each of the strip-shape portion 73 of the back pad 30. In this example, the head pad 10 and the back pad 30 can be coupled by passing the button 76 through any one of the button holes 77, and the position in the up and down direction of the head pad 10 can be changed with respect to the back pad 30 by changing the selection of the button hole 77.

Figure 20E:
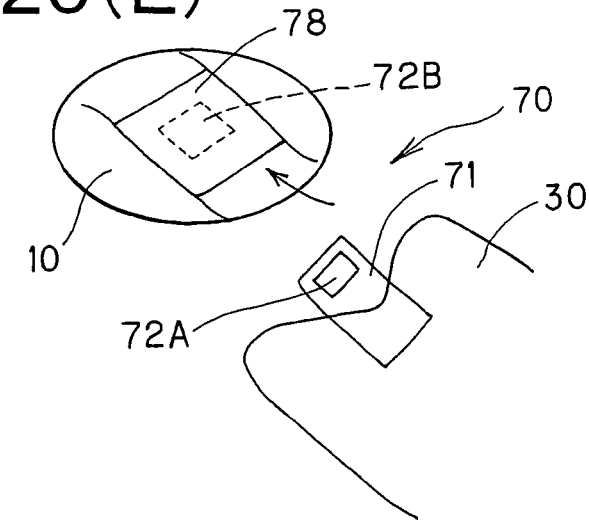
FIG. 20E shows a modification of FIG. 20A.

FIG. 20E is a modification of FIG. 20A, and a cover 78 with which the surface fastener 72B is covered is added to the backside of the head pad 10, and the strip-shape portion 71 of the back pad 30 is made to be able to be inserted in the cover 78 through a lower end opening of the cover 78. In the example, because the surface fastener 72B is not exposed to the backside of the head pad 10, the surface fastener 72B can be used as the male-side surface fastener in which the hook-shape projections exist. In examples of FIGS. 20A to 20E, the pads 10 and 30 can similarly be coupled even if constituents provided in the head pad 10 and back pad 30 are counterchanged.

Figure 21A:
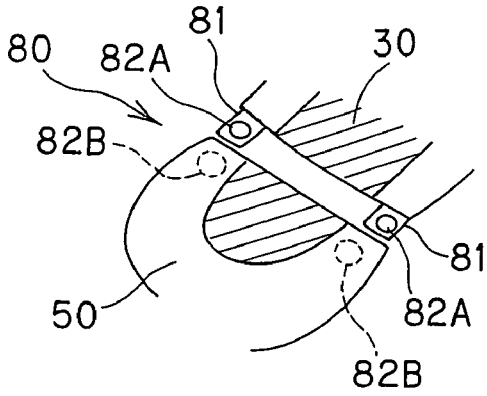
FIG. 21A shows an example in which the back pad and the buttocks pad are coupled by the hook.
Figure 21B:
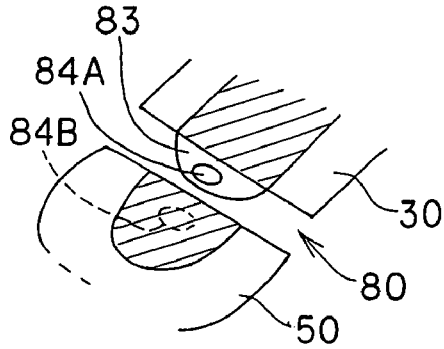
FIG. 21B shows an example in which the back pad and the buttocks pad are coupled by the surface fastener.
Figure 21C:
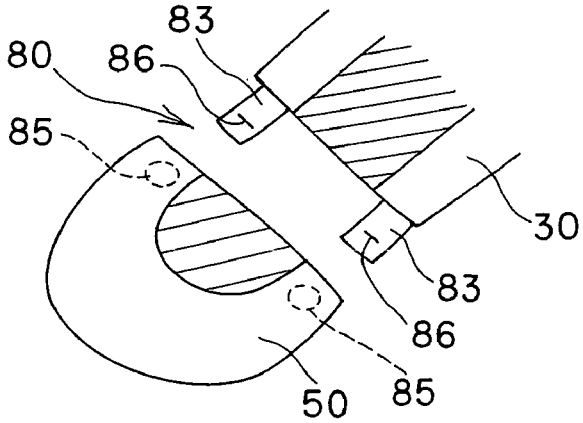
FIG. 21C shows an example in which the back pad and the buttocks pad are coupled by the button.

FIG. 21A to 21C show examples of the coupling portion 80 between the back pad 30 and the buttocks pad 50. FIG. 21A shows the example in which the pads 30 and 50 are coupled by engaging each hook 82A provided on a pair of strip-shape portions 81 of the lower edge of the back pad 30 with a hook 82B provided on the backside of the buttocks pad 50. FIG. 21B shows the example in which the pads 30 and 50 are coupled by overlapping a surface fastener 84A provided on a strip-shape portion 83 in the center of the lower edge of the back pad 30 on a surface fastener 84B provided on the backside of the buttocks pad 50. FIG. 21C shows the example in which the pads 30 and 50 are coupled bypassing a button 85, provided on the backside of the buttocks pad 50, through a button hole 86 of the strip-shape portions 81 of the back pad 30. In examples of FIGS. 21A to 21C, the constituents provided on the back pad 30 and buttocks pad 50 may be counterchanged. In the example of FIG. 21B, it is desirable that the surface fastener 84B is used as the female-side surface fastener.

Figure 22A:
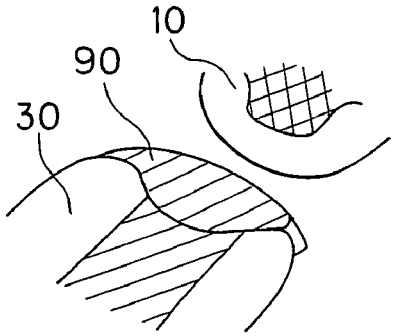
FIG. 22A shows an example in which a cover is provided to cover a coupling portion between the head pad and the back pad therewith.
Figure 22B:
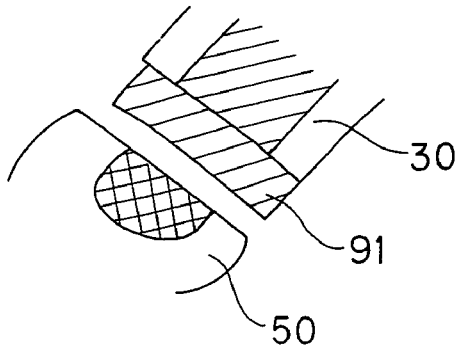
FIG. 22B shows an example in which a cover is provided to cover a coupling portion between the back pad and the buttocks pad therewith.

FIGS. 22A and 22B shows examples in which the covers 90 and 91 with which the coupling portions 70 and 80 are covered are extended from the upper and lower edges in the backside of the back pad 30. The covers 90 and 91 are also shown in FIGS. 3 and 10. When the covers 90 and 91 are provided, the gap is not formed between the coupling portions of the pads 10, 30, and 50, so that the same attitude holding effect or cushioning effect as the integrated cushion can be obtained even if the cushion 9 is formed by the divided structure.

The invention is not limited to the above configurations, but various changes and modifications could be realized as appropriate. For example, the head pad 10 may have the configuration in which the neck support portion 13 and the temporal support portion 14 are separated from each other. In the configuration of the buttocks pad 50, the buttocks support portion 53 and the thigh support portion 54 may be separated from each other. The configuration in which the pad is attached to the seat is not limited to the above examples, but various changes and modifications could be realized as appropriate. For example, the pad can be attached to the seat cover or the seat interior material (cushion material or base plate) using appropriate means such as the hook, a string, a buckle, and the button. Because the belt through holes through which the shoulder belt 6, the lumber belt 7, and the crotch belt 8 are passed are provided in the cover of the seat 3 in the above embodiment, the pads 10, 30, and 50 may be coupled to the seat 3 by utilizing the belt through holes respectively.

What is claimed is:

1. A cushion for a baby chair, where the baby chair is provided with a seat and a reclining mechanism capable of changing an inclination of a back portion of the seat with respect to a seat portion thereof, the cushion comprising:

a head pad for arrangement on the back portion of the seat to support a head of an infant;

a back pad for arrangement on the back portion of the seat to support a back of the infant; and a buttocks pad for arrangement on the seat portion of the seat to support a buttocks of the infant, wherein, the head pad is configured to support the head of the infant by a pair of temporal support portions projecting along opposite first and second side edges of the head pad and a neck support portion extending continuously with and between the pair of temporal support portions along a lower edge of the head pad, the back pad is configured to support opposite sides of a trunk of the infant by a pair of trunk support portions projecting along opposite first and second side edges of the back pad and extended from an upper edge of the back pad to a lower edge of the back pad, the buttocks pad is configured to support the buttocks of the infant by a buttocks support portion projecting along a lower edge of the buttocks pad, the buttocks pad is further configured to support a thigh and a knee of the infant by a pair of thigh support portions projecting along opposite first and second side edges of the buttocks pad, the head pad, the back pad, and the buttocks pad are configured to be coupleable with one another, and further configured to be separable from one another, each of the trunk support portions gradually decreases in height from a first end portion of the trunk support portion on a lower edge side of the back pad to a second end portion of the trunk support portion on an upper edge side of the back pad, the back pad and the buttocks pad are configured such that when the back pad and the buttocks pad are coupled, an edge line of the trunk support portion and an edge line of the thigh support portion are continuous, and inclined surfaces are formed at respective facing end portions of the trunk support portion and the thigh support portion, the inclined surfaces configured to avoid an interference of the trunk support portion and the buttocks pad when the back portion of the seat is raised with respect to the seat portion.

2. The cushion according to claim 1, wherein an edge line of the neck support portion is curved about a height direction so as to form a concave curve line, the bottom of the curved line being a central portion in a right and left direction of the head pad.

3. The cushion according to claim 1, wherein, a support surface is provided on an inner periphery of the temporal support portion, and the support surface extends and slopes down toward a recess portion surrounded by the neck support portion and the temporal support portion.

4. The cushion according to claim 1, wherein an edge line of the temporal support portion is gradually lowered toward the upper edge side of the head pad.

5. The cushion according to claim 1, wherein a projection portion does not exist in at least a central portion of the upper edge of the head pad, thereby the recess portion surrounded by the neck support portion and the temporal support portion is opened to the upper edge side of the head pad.

6. The cushion according to claim 1, wherein an edge line of the buttocks support portion of the buttocks pad is curved to form a U-shape where a central portion of the right and left direction of the buttocks support portion forms the bottom of the U-shape in a longitudinal direction of the seat.

7. The cushion according to claim 6, wherein the buttocks support portion and the pair of thigh support portions are integrally connected.

8. The cushion according to claim 1, wherein a coupling portion between the head pad and the back pad is configured such that the head pad can be adjusted in an up and down direction of the seat with respect to the back pad.

9. The cushion according to claim 1, further comprising:

a cover covering a coupling portion between the head pad and the back pad and a coupling portion between the back pad and the buttocks pad.

10. The cushion according to claim 1, wherein the temporal support portions of the head pad terminate before an upper edge of the had pad such that a center of the upper edge of the head pad is free of said temporal support portions, the neck support portion and the temporal support portions forming a recess portion bounded by the neck support portion and the temporal support portions and open at the upper edge of the head pad.

* * * * *